US006846338B2

(12) United States Patent
Krull et al.

(10) Patent No.: US 6,846,338 B2
(45) **Date of Patent: *Jan. 25, 2005**

(54) FUEL OILS BASED ON MIDDLE DISTILLATES AND COPOLYMERS OF ETHYLENE AND UNSATURATED CARBOXYLIC ESTERS

(75) Inventors: Matthias Krull, Oberhausen (DE); Werner Reimann, Frankfurt (DE); Markus Kupetz, Dinslaken (DE); Waltraud Nagel, Oberhausen (DE); Raimund Wildfang, Oberhausen (DE)

(73) Assignee: Clariant GmbH, Frankfurt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/788,261

(22) Filed: Feb. 19, 2001

(65) Prior Publication Data

US 2001/0034968 A1 Nov. 1, 2001

Related U.S. Application Data

(63) Continuation-in-part of application No. 09/111,548, filed on Jul. 7, 1998, now abandoned.

(30) Foreign Application Priority Data

Jul. 8, 1997 (DE) ..... 197 29 055

(51) Int. Cl.[7] ..... C10L 1/18
(52) U.S. Cl. ..... 44/393; 44/395
(58) Field of Search ..... 44/393, 395; 523/331

(56) References Cited

U.S. PATENT DOCUMENTS

| | | | | |
|---|---|---|---|---|
| 2,473,996 | A | 6/1949 | Hanford | 526/326 |
| 3,048,479 | A | 8/1962 | Ilnyckyj et al. | 44/62 |
| 3,145,194 | A | 8/1964 | Heikmaier et al. | 526/326 |
| 3,394,114 | A | 7/1968 | Anderson | 526/331 |
| 3,562,229 | A | 2/1971 | Bauer et al. | 526/331 |
| 3,640,834 | A | 2/1972 | Oberst et al. | 526/331 |
| 3,762,888 | A | 10/1973 | Kober et al. | 44/39 |
| 3,792,983 | A | 2/1974 | Tunkel et al. | 44/393 |
| 4,153,424 | A | 5/1979 | Wisotsky | 44/395 |
| 4,211,534 | A | 7/1980 | Feldman | 44/62 |
| 4,261,703 | A | 4/1981 | Tack et al. | 44/374 |
| 4,375,973 | A | 3/1983 | Rossi et al. | 44/394 |
| 4,664,676 | A | 5/1987 | Denis et al. | 44/351 |
| 4,670,516 | A | 6/1987 | Sackmann et al. | 525/327.6 |
| 4,713,088 | A | 12/1987 | Tack et al. | 44/62 |
| 4,863,486 | A | 9/1989 | Tack et al. | 44/397 |
| 4,985,048 | A | 1/1991 | Wirtz et al. | 44/394 |
| 5,186,720 | A | 2/1993 | Feustel et al. | 44/351 |
| 5,200,484 | A | 4/1993 | Reimann | 526/331 |
| 5,205,839 | A | 4/1993 | Reimann | 44/393 |
| 5,254,652 | A | 10/1993 | Reimann et al. | 526/331 |
| 5,391,632 | A | 2/1995 | Krull et al. | 525/327.6 |
| 6,143,043 | A | 11/2000 | Botros | 44/346 |

FOREIGN PATENT DOCUMENTS

| | | |
|---|---|---|
| DE | 1147799 | 8/1960 |
| DE | 1162630 | 2/1964 |
| DE | 1914756 | 11/1969 |
| DE | 196 45 603 A1 | 5/1998 |
| DE | 19700159 | 7/1998 |
| EP | 0099646 | 2/1983 |

(List continued on next page.)

OTHER PUBLICATIONS

U.S. patent application Ser. No. 09/808,454, Ana Woodard, filed Mar. 14, 2001.

U.S. patent application Ser. No. 09/808,481, Nathan Marter, filed Mar. 14, 2001.

Chemical Abstract, vol. 61 p. 5438, date unknown.

European Search Report, date unknown.

*Primary Examiner*—Cephia D. Toomer
(74) *Attorney, Agent, or Firm*—Richard P. Silverman

(57) ABSTRACT

A fuel oil comprising:

A) a mineral oil having a cloud point of less than −8° C., a boiling range (90–20%) of less than 120° C. and a difference between CFPP and PP of less than 10° C., and B) one or more copolymers, wherein the copolymers comprise:

a) bivalent structural unit (B1), wherein (B1) is a bivalent structural unit of formula (1)

$$—CH_2—CH_2— \quad (1)$$

and b) one or more bivalent structural units (B2), wherein (B2) is either a bivalent structural unit of formula (2)

$$—CH_2—CR^1R^2— \quad (2)$$

in which $R^1$ is hydrogen or methyl, $R^2$ is $COOR^3$, $OR^3$ or $OCOR^3$, and $R^3$ is an alkyl radical having at least 4 and at most 30 carbon atoms, or (B2) is a bivalent structural unit of formula (2a)

(2a)

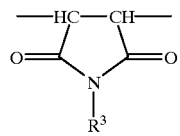

in which $R^3$ is an alkyl radical having at least 4 and at most 30 carbon atoms.

16 Claims, No Drawings

FOREIGN PATENT DOCUMENTS

| | | |
|---|---|---|
| EP | 0111888 | 6/1984 |
| EP | 0 153 176 B1 | 8/1985 |
| EP | 0 154 177 A2 | 9/1985 |
| EP | 0203554 | 12/1986 |
| EP | 0217602 | 4/1987 |
| EP | 0 271 738 A2 | 6/1988 |
| EP | 0301837 | 2/1989 |
| EP | 0 320 766 A2 | 6/1989 |
| EP | 0360419 | 3/1990 |
| EP | 0 413 279 A1 | 2/1991 |
| EP | 0463518 | 1/1992 |
| EP | 0493769 | 7/1992 |
| EP | 0 606 055 A2 | 7/1994 |
| EP | 0184083 | 11/1996 |
| EP | 0741181 | 11/1996 |
| EP | 0 746 598 B1 | 12/1996 |
| FR | 2114718 | 6/1972 |
| GB | 11650084 | 9/1969 |
| WO | WO 94/00537 | 1/1994 |
| WO | WO 95/23200 | 8/1995 |
| WO | WO 96/17905 | 6/1996 |
| WO | WO 98/20056 | 5/1998 |

FUEL OILS BASED ON MIDDLE DISTILLATES AND COPOLYMERS OF ETHYLENE AND UNSATURATED CARBOXYLIC ESTERS

CROSS-REFERENCE TO RELATED APPLICATION

The present application is a continuation-in-part of U.S. application Ser. No. 09/111,548, filed on Jul. 7, 1998 now abandoned.

FIELD OF THE INVENTION

The present invention relates to fuel oils which comprise middle distillates and copolymers of ethylene and esters of unsaturated carboxylic acids and which exhibit improved cold flow behavior.

BACKGROUND OF THE INVENTION

Crude oils and middle distillates such as gas oil, diesel oil or heating oil, obtained by distillation of crude oils, contain, depending on the origin of the crude oils, different amounts of n-paraffins, which crystallize out as lamellar crystals when the temperature is lowered and in some cases agglomerate with inclusion of oil. This results in a deterioration in the flow properties of these oils or distillates, giving rise to problems, for example in the recovery, transport, storage and/or use of the mineral oils and mineral oil distillates. In the case of mineral oils, this crystallization phenomenon can lead to deposits on the pipe walls during transport through pipelines, especially in the winter, and in individual cases, for example when the pipeline is shut down, even to complete blockage thereof. The precipitation of paraffins can also cause difficulties in storage and further processing of the mineral oils. Thus, it may be necessary in winter to store the mineral oils in heated tanks. In the case of mineral oil distillates, blockage of the filters in diesel engines and furnaces may occur owing to the crystallization, with the result that reliable metering of the fuels is prevented and complete interruption of the fuel or heating medium feed may occur.

In addition to the traditional methods for eliminating the paraffins which have crystallized out (thermally, mechanically or by means of solvents), which relate only to the removal of the precipitates already formed, recent years have seen the development of chemical additives (so-called flow improvers or paraffin inhibitors) which physically interact with the precipitating paraffin crystals and thus modify their shape, size and adhesion properties. The additives act as additional crystal seeds and partially crystallize out with the paraffins, resulting in a larger number of smaller paraffin crystals with modified crystal shapes. A part of the action of the additives is also explained by dispersing of the paraffin crystals. Modified paraffin crystals have less tendency to agglomerate, so that the oils into which additives have been introduced can be pumped or processed even at temperatures which are often more than 20° lower than in the case of oils not containing additives.

The flow and low-temperature behavior of mineral oils and mineral oil distillates is described by stating the pour point (determined according to ISO 3016) and the cold filter plugging point (CFPP; determined according to EN 116). Both characteristics are measured in °C.

Typical flow improvers for crude oil and middle oil distillates are copolymers of ethylene with carboxylic esters of vinyl alcohol. Thus, according to DE-A-11 47 799, oil-soluble copolymers of ethylene and vinyl acetate having a molecular weight between about 1,000 and 3,000 are added to mineral oil distillate fuels having a boiling point between about 120 and 400° C. Copolymers which contain from about 60 to 99% by weight of ethylene and from about 1 to 40% by weight of vinyl acetate are preferred. They are particularly effective if they were prepared by free radical polymerization in an inert solvent at temperatures of from about 70 to 130° C. and pressures of from 35 to 2,100 atm (gauge pressure) (DE-A-19 14 756).

Other polymers used as flow improvers contain, in addition to ethylene and vinyl acetate, for example 1-hexene (cf. EP-A-0 184 083), diisobutylene (cf. EP-A-0 203 554) or an isoolefin of the formula

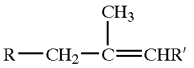

in which R and R' are identical or different and are hydrogen or $C_1$–$C_4$-alkyl radicals (EP-A-0 099 646). Copolymers of ethylene, alkenecarboxylic esters and/or vinyl esters and vinyl ketone are also used as pour point depressants and for improving the flow behavior of crude oils and middle distillates of crude oils (EP-A-0 111 888).

In addition, copolymers based on α,β-unsaturated compounds and maleic anhydride are also used as flow improvers. DE-196 45 603 describes copolymers of from 60 to 99 mol % of structural units derived from ethylene and from 1 to 40 mol % of structural units which are derived from maleic acid, its anhydride or its imides.

DE-1 162 630 discloses copolymers of ethylene and vinyl esters of straight-chain fatty acids having 4 to 18 carbon atoms as a pour point-depressing additive for distillate fuels having a medium boiling point, such as heating oil or diesel oil.

EP-A-0 217 602 discloses ethylene copolymers with vinyl esters carrying $C_1$- to $C_{18}$-alkyl radicals as flow improvers for mineral oil distillates having boiling ranges (90–20%) of less than 100° C.

EP-A-0 493 769 discloses terpolymers which are prepared from ethylene, vinyl acetate and vinyl neononanoate or neodecanoate, and their use as additives for mineral oil distillates.

EP-A-0 746 598 discloses copolymers of ethylene and dialkyl fumarates as a mixture with mineral oils which a cloud point of less than −10° C.

The efficacy of the known additives for improving the properties of mineral oil fractions is dependent, inter alia, on the origin of the mineral oil from which they were obtained and, hence, in particular on its composition. Additives which are very suitable for establishing specific properties of fractions of a crude oil can therefore lead to completely unsatisfactory results in the case of distillates of crude oils of different origin.

Against the background of the increased environmental consciousness, fuels which give rise to less environmental pollution during their combustion have recently been produced. Appropriate diesel fuels are distinguished by a very low sulfur content of less than 500 ppm and in particular less than 100 ppm, a low aromatics content and a low density of less than 0.86, in particular less than 0.84, g/ml. They cannot be treated with conventional flow improvers or can be treated therewith only to an inadequate extent. In particular, the winter grades of diesel fuels produced for use under arctic conditions and having extreme low-temperature properties, such as, for example, a cloud point of less than −8° C. and in particular less than −15° C., very narrow distillation cuts with boiling ranges of 20 to 90% by volume below 120° C., in particular below 100° C. and in some cases also below 80° C., and a distillation volume of 95% by volume at temperatures below 360° C., in particular below 350° C. and especially below 330° C., present problems. The low-temperature properties of such distillates can be satisfactorily improved at present only by adding low-boiling, low-paraffin components, such as, for example, kerosene.

The composition caused by narrow distillation cuts and low final boiling points presents problems with regard to the response behavior of flow improvers in these oils. These oils have a paraffin distribution with a maximum at about $C_{12}$ to $C_{14}$ and contain only insignificant amounts of the n-paraffins crystallizing out of conventional grades and having hydrocarbon chains longer than $C_{18}$. The cloud points and CFPP values are so low, especially in the case of winter grades, that conventional flow improvers do not respond and the low-temperature properties must be established by dilution with kerosine.

It was therefore an object of the present invention to develop new fuel oils having an improved low-temperature flowability compared with the prior art.

Surprisingly, it has been found that main chain polymers of ethylene which carry side chains having more than 5 carbon atoms are suitable for lowering the CFPP also in the above described middle distillates. Ethylene/vinyl acetate copolymers having corresponding comonomer contents are on the other hand virtually insoluble in hydrocarbons.

SUMMARY OF THE INVENTION

The present invention relates to a fuel oil comprising:

A) a mineral oil having a cloud point of less than −8° C., a boiling range (90–20%) of less than 120° C. and a difference between CFPP and PP of less than 10° C., and B) one or more copolymers, wherein the copolymers comprise:

a) bivalent structural unit (B1), wherein (B1) is a bivalent structural unit of formula (1)

$$—CH_2—CH_2— \quad (1)$$

and b) one or more bivalent structural units (B2), wherein (B2) is either a bivalent structural unit of formula (2)

$$—CH_2—CR^1R^2— \quad (2)$$

in which $R^1$ is hydrogen or methyl, $R^2$ is $COOR^3$, $OR^3$ or $OCOR^3$, and $R^3$ is an alkyl radical having at least 4 and at most 30 carbon atoms, or (B2) is a bivalent structural unit of formula (2a)

(2a)

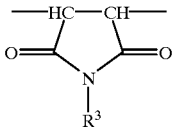

in which $R^3$ is an alkyl radical having at least 4 and at most 30 carbon atoms.

DESCRIPTION OF THE PREFERRED EMBODIMENTS

As stated above, the present invention relates to a fuel oil comprising:

A) a mineral oil having a cloud point of less than −8° C., a boiling range (90–20%) of less than 120° C. and a difference between CFPP and PP of less than 10° C., and B) one or more copolymers, wherein the copolymers comprise:

a) bivalent structural unit (B1), wherein (B1) is a bivalent structural unit of formula (1)

$$—CH_2—CH_2— \quad (1)$$

and b) one or more bivalent structural units (B2), wherein (B2) is either a bivalent structural unit of formula (2)

$$—CH_2—CR^1R^2— \quad (2)$$

in which $R^1$ is hydrogen or methyl, $R^2$ is $COOR^3$, $OR^3$ or $OCOR^3$, and $R^3$ is an alkyl radical having at least 4 and at most 30 carbon atoms, or (B2) is a bivalent structural unit of formula (2a)

(2a)

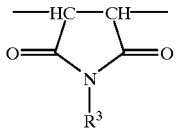

in which $R^3$ is an alkyl radical having at least 4 and at most 30 carbon atoms.

As for B2), $R^1$ is preferably hydrogen. $R^3$ is preferably a linear or branched $C_5$–$C_{24}$-alkyl radical, particularly preferably a linear or branched $C_8$–$C_{18}$-alkyl radical. In a further, particularly preferred embodiment of the present invention, $R^3$ is a neoalkyl radical having 7 to 11 carbon atoms, in particular a neoalkyl radical having 8, 9 or 10 carbon atoms. The neoalkanoic acids from which the above-mentioned neoalkyl radicals can be derived are described by the formula (3):

(3)

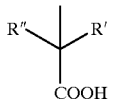

R' and R" are linear alkyl radicals having together preferably 5 to 9, in particular 6, 7 or 8, carbon atoms. The vinyl ester used for the copolymerization accordingly has the formula (4):

(4)

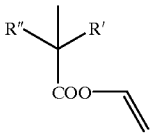

wherein R' and R" are defined as in formula (3).

Further suitable comonomers are those which can be derived from acrylic acid:

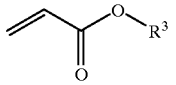

(5)

wherein $R^3$ is an alkyl radical having at least 4 and at most 30 carbon atoms. Preferred radicals $R^3$ are, for example, butyl, tert-butyl, pentyl, neopentyl, octyl, 2-ethylhexyl, decyl, dodecyl, tetradecyl, hexadecyl, octadecyl and behenyl.

The sulfur content of the mineral oils stated under A) is preferably less than 500, particularly less than 300, ppm, especially less than 100 ppm. Their cloud point is preferably less than −15° C. The boiling ranges (90–20%) of the distillation cuts are preferably less than 100° C., in particular less than 80° C. The use of mineral oils having a 95% distillation point of less than 360° C., in particular less than 350° C., especially less than 330° C., is preferred.

The fuel oil compositions according to the present invention preferably comprise copolymers in which the comonomers (B1) are present in an amount of from 85 to 97 mol % and the comonomers (B2) are present in an amount of from 3 to 15 mol %. From 4 to 10 mol % of (B2) and from 90 to 96 mol % of (B1) are particularly preferred. The copolymers stated under B) can be prepared by the conventional copolymerization methods, such as, for example, suspension polymerization, solution polymerization, gas-phase polymerization or high-pressure mass polymerization. The high-pressure mass polymerization at pressures of, preferably, from 50 to 400, in particular from 100 to 300, MPa and temperatures of, preferably, from 50 to 300° C., in particular from 100 to 250° C., is preferred. The reaction of the monomers is initiated by initiators forming free radicals (free radical chain initiators). This class of substances includes, for example, oxygen, hydroperoxides, peroxides and azo compounds, such as cumyl hydroperoxide, tert-butyl hydroperoxide, dilauroyl peroxide, dibenzoyl peroxide, bis(2-ethylhexyl)peroxocarbonate, tert-butyl perpivalate, tert-butyl permaleate, tert-butyl perbenzoate, dicumyl peroxide, tert-butyl cumyl peroxide, di-(tert-butyl) peroxide, 2,2'-azobis(2-methylpropanonitrile) and 2,2'-azobis(2-methylbutyronitrile). The initiators are used individually or as a mixture comprising two or more substances in amounts of from 0.001 to 20% by weight, preferably from 0.01 to 10% by weight, based on the monomer mixture.

Preferably, the copolymers stated under B) have melt viscosities at 140° C. of from 20 to 10,000 mPas, in particular from 30 to 5000 mPas, especially from 50 to 2000 mPas. The desired melt viscosity of these copolymers is established for a given composition of the monomer mixture by varying the reaction parameters pressure and temperature and, if required, by adding moderators. Hydrogen, saturated or unsaturated hydrocarbon, e.g. propane, aldehydes, e.g. propionaldehyde, n-butyraldehyde or isobutyraldehyde, ketones, e.g. acetone, methyl ethyl ketone, methyl isobutyl ketone or cyclohexanone, or alcohols, e.g. butanol, have proven useful as moderators. Depending on the intended viscosity, the moderators are used in amounts of up to 20% by weight, preferably from 0.05 to 10% by weight, based on the monomer mixture.

The copolymers stated under B) may optionally comprise up to 4% by weight of vinyl acetate. The copolymers stated under B) may optionally comprise up to 5% by weight of further comonomers wherein further comonomers include copolymers except vinyl acetate (i.e. since vinyl acetate may only be present up to 4% by weight). Such further comonomers include, but are not limited to, vinyl esters, vinyl ethers, alkyl acrylates, alkyl methacrylates or higher olefins having at least 5 carbon atoms. Preferred higher olefins are hexene, 4-methylpentene, octene or diisobutylene.

In order to obtain the copolymers stated under B), monomer mixtures which comprise, in addition to ethylene and, if required, a moderator, from 1 to 50% by weight, preferably from 3 to 40% by weight, of comonomers are used. The different polymerization rates of the monomers are taken into account by virtue of the fact that the composition of the monomer mixture differs from the composition of the copolymer. The polymers are obtained as colorless melts which solidify to waxy solids at room temperature.

The high-pressure mass polymerization is carried out batchwise or continuously in known high-pressure reactors, for example, autoclaves or tube reactors; tube reactors have proven particularly useful. Solvents, such as aliphatic and/or aromatic hydrocarbons or hydrocarbon mixtures, benzene or toluene, may be contained in the reaction mixture. The solvent-free procedure is preferred. In a preferred embodiment of the polymerization, the mixture comprising the monomers, the initiator and, if used, the moderator is fed to a tube reactor via the reactor inlet and via one or more side branches. The monomer streams may have different compositions here (EP-A-0 271 738).

The copolymers stated under B) are added to the mineral oils or mineral oil distillates stated under A) in the form of solutions or dispersions. These solutions or dispersions comprise preferably from 1 to 90, in particular from 10 to 80, % by weight of the copolymers. Suitable solvents or dispersants are aliphatic and/or aromatic hydrocarbons or hydrocarbon mixtures, for example gasoline fractions, kerosine, decane, pentadecane, toluene, xylene, ethylbenzene or commercial solvent mixtures, such as Solvent Naphtha, SHELLSOL® AB, SOLVESSO® 150, SOLVESSO® 200, EXXSOL®, ISOPAR® and SHELLSOL® D types. The fuel oils according to the present invention comprise preferably from 0.001 to 2, in particular from 0.005 to 0.5, % by weight of copolymer, based on the distillate.

The compound of the formula (2a) is a copolymerized maleic imide, the imide itself having a double bond between the —CH—CH— groups. The compound of the formula (2a) can either be produced by copolymerizing a maleic imide, or by copolymerizing maleic acid/maleic anhydride and subsequent imidization of the copolymer with an amine.

The fuel oils according to the present invention may comprise further oil-soluble co-additives which by themselves improve the cold flow properties of crude oils, lubricating oils or fuel oils. Examples of such coadditives are vinyl acetate-containing copolymers or terpolymers of ethylene, polar compounds which disperse paraffins (paraffin dispersants) and comb-like polymers.

Oil-soluble polar compounds having ionic or polar groups, for example, amine salts and/or amides, which are obtained by reacting aliphatic or aromatic amines, preferably long-chain aliphatic amines, with aliphatic or aromatic mono-, di-, tri- or tetracarboxylic acids or anhydrides thereof have proven useful as paraffin dispersants (cf. U.S. Pat. No. 4,211,534). Other paraffin dispersants are copolymers of maleic anhydride and α,β-unsaturated compounds, which, if required, can be reacted with primary monoalkylamines and/or aliphatic alcohols (cf. EP-A-0 154 177), the reaction products of alkenylspirobislactones with amines (cf. EP-A-0 413 279) and, according to EP-A-0 606 055, reaction products of terpolymers based on α,β-unsaturated dicarboxylic anhydrides, α,β-unsaturated compounds and polyoxyalkenyl ethers of lower unsaturated alcohols.

Comb-like polymers are polymers in which carbon radicals having at least 8, in particular at least 10, carbon atoms are bonded to a polymer skeleton. They are preferably homopolymers whose alkyl side chains contain at least 8 and in particular at least 10 carbon atoms. In the case of copolymers, at least 20%, preferably at least 30%, of the monomers have side chains (cf. Comb-like Polymers—Structure and Properties; N. A. Platé and V. P. Shibaev, J. Polym. Sci. Macromolecular Revs. 1974, 8, 117 et seq.). Examples of suitable comb-like polymers are fumarate/vinyl acetate copolymers (cf. EP-A-0 153 176), copolymers of a $C_6$–$C_{24}$-α-olefin and an N—$C_6$- to $C_{22}$-alkylmaleimide (cf. EP-A-0 320 766) and furthermore esterified olefin/maleic anhydride copolymers, polymers and copolymers of α-olefins and esterified copolymers of styrene and maleic anhydride.

The novel fuel oils of the present invention may comprise other additives, for example, dewaxing assistants, corrosion inhibitors, antioxidants, lubricity additives and sludge inhibitors.

EXAMPLES

The following additives A1 to A5 were prepared:

A1: Ethylene-MA copolymer imidated with coconut fatty alkylamine and comprising 30% by weight (8 mol %) of MA.

A2: Ethylene-VeoVa copolymer comprising 7 mol % of VeoVa 10 and having a $V_{140}$ of 200 mPas.

A3: Ethylene-VeoVa copolymer comprising 14 mol % of VeoVa 10 and having a $V_{140}$ of 270 mPas.

A4: Ethylene-VeoVa copolymer comprising 7 mol % of VeoVa 11 and having a $V_{140}$ of 84 mPas.

A5: Copolymer of ethylene and 8 mol % of stearyl acrylate, having a $V_{140}$ of 65 mPas.

MA=maleic anhydride

VeoVa 10/11=vinyl neodecanoate/neoundecanoate $V_{140}$=melt viscosity of the copolymer, determined according to ISO 3219 using the plate-and-cone measuring system at 140° C.

Efficiency of the Additive

Table 3 shows the efficiency of the additives as flow improvers for mineral oil distillates on the basis of the CFPP test (Cold Filter Plugging Test according to EN 116) in different distillates from Scandinavian refineries. The additives are used as 50% strength solutions in Solvent Naphtha. As a comparison, the efficiency of a commercial ethylene-vinyl acetate copolymer (EVA copolymer) containing 13.3 mol % of vinyl acetate and having a melt viscosity $V_{140}$ of 125 mPas (V1) and that of a commercial ethylene-vinyl acetate-vinyl neodecanoate terpolymer containing 16 mol % of vinyl acetate and 1.2 mol % of vinyl neodecanoate and having a melt viscosity $V_{140}$ of 140 mPas (V2) are shown.

TABLE 2

Characterization of the test oils:

| | Test oil 1 | Test oil 3 | Test oil 4 | Test oil 5 | Test oil 6 |
|---|---|---|---|---|---|
| Initial boiling point | 195° C. | 127° C. | 190° C. | 192° C. | 183° C. |
| 20% | 226° C. | 193° C. | 219° C. | 218° C. | 226° C. |
| 90% | 280° C. | 318° C. | 291° C. | 288° C. | 330° C. |
| 95% | 300° C. | 330° C. | 311° C. | 306° C. | 347° C. |
| Cloud Point | −30° C. | −23° C. | −24° C. | −27° C. | −9° C. |
| CFPP | −31° C. | −23° C. | −29° C. | −34° C. | −12° C. |
| Pour Point | −30° C. | −42° C. | −27° C. | −27° C. | −21° C. |
| CFPP-PP | −1° C. | 19° C. | −2° C. | −7° C. | 9° C. |
| Density (15°) | 0.821 | 0.822 | 0.817 | 0.819 | 0.835 |

The CFPP is determined according to EN116 and the PP according to ISO 3016 using an automatic apparatus (Herzog MC 852).

TABLE 3

CFPP efficiency

| | Test oil 1 | | | | Test oil 3 | | | Test oil 4 | | | Test oil 5 | | | Test oil 6 | | |
|---|---|---|---|---|---|---|---|---|---|---|---|---|---|---|---|---|
| | 100 ppm | 200 ppm | 400 ppm | 1000 ppm | 100 ppm | 200 ppm | 400 ppm | 100 ppm | 250 ppm | 500 ppm | 50 ppm | 100 ppm | 250 ppm | 50 ppm | 100 ppm | 200 ppm |
| A1 | −38 | −40 | <−40 | <−40 | | | | −36 | −36 | −40 | −39 | −39 | <−40 | | | |
| A2 | −38 | −39 | −40 | <−40 | −28 | <−40 | <−40 | −36 | −38 | −39 | | | | −18 | −20 | −23 |
| A3 | −33 | −35 | −38 | −40 | <−40 | <−40 | <−40 | | | | | | | −16 | −17 | −19 |
| A4 | −36 | −38 | −39 | <−40 | | | | | | | | | | | | |
| A5 | −39 | <−40 | <−40 | <−40 | | | | | | | | | | | | |
| V1 | −37 | −35 | −35 | −34 | −26 | −38 | <−40 | −35 | −34 | −34 | −39 | −36 | −35 | −17 | −20 | −22 |
| V2 | −33 | −35 | −35 | −33 | −26 | −35 | −39 | −35 | −34 | −33 | | | | −11 | −15 | −22 |

List of the Tradenames Used

| | |
|---|---|
| Solvent Naphtha | aromatic solvent mixtures having a boiling SHELLSOL ® AB range from 180 to 210° C. |
| SOLVESSO ® 150 | aromatic solvent mixture having a boiling range of from 180 to 210° C. |
| SOLVESSO ® 200 | aromatic solvent mixture having a boiling range from 230 to 287° C. |
| EXXSOL ® | dearomatized solvent having various boiling ranges, for example EXXSOL ® D60: 187 to 215° C. |
| ISOPAR ® (Exxon) | isoparaffinic solvent mixture having various boiling ranges, for example ISOPAR ® L: 190 to 210° C. |
| SHELLSOL ® D | mainly aliphatic solvent mixtures having various boiling ranges |

We claim:

1. A fuel oil middle distillate composition consisting of:

A) a mineral oil having a cloud point of less than −8° C., a boiling range (90–20%) of less than 120° C., a 95% distillation point of less than 350° C. and a difference between CFPP and PP of less than 10° C., and B) a flow improver consisting of:

1) one or more copolymers present in an amount of 0.001 to 2% by weight, based on the weight of the oil, wherein the copolymers have melt viscosities of from 20 to 10,000 mPas at 140° C. and wherein the copolymers consist of a) and b):

a) bivalent structural unit (B1) present in an amount of from 85 to 97 mol % wherein (B1) is a bivalent structural unit of formula (1)

$$—CH_2—CH_2— \quad (1)$$

and b) one or more bivalent structural units (B2) present in an amount of from 3 to 15 mol %, (B2) is a bivalent structural unit of formula (2):

$$—CH_2—CR^1R^2— \quad (2)$$

in which $R^1$ is hydrogen or methyl, $R^2$ is $COOR^3$, $OR^3$ or $OCOR^3$, and $R^3$ is an alkyl radical having at least 4 and at most 30 carbon atoms, wherein the copolymers consist of from 0 to 4% by weight of vinyl acetate and of from 0 to 5% by weight of further comonomers except vinyl acetate; and wherein said fuel oil middle distillate contains other additives selected from the group consisting of dewaxing assistants, corrosion inhibitors, antioxidants, lubricity additives, sludge inhibiters, paraffin dispersants, vinyl acetate-containing terpolymers of ethylene, and mixtures, thereof.

2. The fuel oil composition as claimed in claim 1, wherein $R^1$ is hydrogen.

3. The fuel oil composition as claimed in claim 1, wherein $R^3$ of formula (2) in the bivalent structural units (B2) is $C_5$–$C_{24}$-alkyl or a neoalkyl radical having 7 to 11 carbon atoms.

4. The fuel oil composition as claimed in claim 1, wherein $R^3$ of formula (2) in the bivalent structural units (B2) is $C_8$–$C_{18}$-alkyl or a neoalkyl radical having 8, 9, or 10 carbon atoms.

5. The fuel oil composition as claimed in claim 1, wherein the copolymers stated under B) have melt viscosities at 140° C. of from 30 to 5000 mPas.

6. The fuel oil composition as claimed in claim 1, wherein the copolymers stated under B) have melt viscosities at 140° C. of from 50 to 2000 mPas.

7. The fuel oil composition as claimed in claim 1, wherein the structural units of formula (2) of (B1) and (B2) stated under (B) are selected from the group consisting of vinyl ethers, alkylacrylates, alkyl methacrylates, higher olefins having at least 5 carbon atoms, and mixtures thereof.

8. The fuel oil composition as claimed in claim 7 wherein the higher olefins are selected from the group consisting of hexene, 4-methylpentene, octene, dilsobutylene, and mixtures thereof.

9. The fuel oil composition as claimed in claim 1, wherein the mineral oils stated under A) have sulfur contents of less than 500 ppm.

10. The fuel oil composition as claimed in claim 1, wherein the mineral oils stated under A) have sulfur contents of less than 300 ppm.

11. The fuel oil composition as claimed in claim 1, wherein the mineral oils stated under A) have sulfur contents of less than 100 ppm.

12. The fuel oil composition as claimed in claim 1, wherein the mineral oil has a cloud point of below −15° C.

13. The fuel oil composition as claimed in claim 1, wherein mineral oil has a boiling range (90–20%) of less than 100° C.

14. The fuel oil composition as claimed in claim 1, wherein mineral oil has a boiling range (90–20%) of less than 80° C.

15. The fuel oil composition as claimed in claim 1, wherein the composition comprises from 85 to 96 mol % of comonomers (B1) and from 3 to 15 mol % of comonomers (B2).

16. The fuel oil composition as claimed in claim 1, wherein the composition comprises from 90 to 96 mol % of comonomers (B1) and from 4 to 10 mol % of comonomers (B2).

* * * * *